United States Patent [19]

Pizzuto et al.

[11] 4,159,012

[45] Jun. 26, 1979

[54] DIAPHRAGM TYPE CARBURETOR FOR A TWO-STROKE CYCLE ENGINE

[75] Inventors: Russell Pizzuto; Joseph R. Marino, both of Charlotte, N.C.

[73] Assignee: Textron Inc., Providence, R.I.

[21] Appl. No.: 806,070

[22] Filed: Jun. 13, 1977

[51] Int. Cl.[2] ..... F02B 75/02; F02M 17/04

[52] U.S. Cl. ..... 123/65 R; 261/35; 261/DIG. 68

[58] Field of Search ..... 123/65 R, 119 G, DIG. 8, 123/73 A; 261/69 A, 35, DIG. 68, 39 D

[56] References Cited

U.S. PATENT DOCUMENTS

| | | | |
|---|---|---|---|
| 3,320,937 | 5/1967 | Meininger | 260/DIG. 68 |
| 3,441,010 | 4/1969 | Barr et al. | 261/DIG. 68 |
| 3,453,994 | 7/1969 | Nutten et al. | 261/DIG. 68 |
| 3,472,211 | 10/1969 | Meininger | 261/DIG. 68 |
| 3,738,623 | 6/1973 | Tuckey | 261/DIG. 68 |
| 3,743,254 | 7/1973 | Tuckey | 261/DIG. 68 |
| 3,746,320 | 7/1973 | Van Camp et al. | 261/DIG. 68 |

*Primary Examiner*—Charles J. Myhre
*Assistant Examiner*—David D. Reynolds
*Attorney, Agent, or Firm*—Robert E. Burns; Emmanuel J. Lobato; Bruce L. Adams

[57] ABSTRACT

A port in the cylinder wall of a two-stroke cycle engine is connected by a passage and a restricted orifice with the idle reservoir of a diaphragm type carburetor. The idle reservoir is connected through an adjustable idle mixture valve with the metering chamber. The passage from the engine port is connected by a vent passage with the venturi of the carburetor. The dry side of the metering diaphragm is vented by a restricted opening and is connected with the dry side of a crankcase pressure operated fuel pump through a passageway having therein a check valve and a valve which is open when the choke valve is closed. This connection allows pressure pulses from the crankcase to influence fuel flow so that the desired fuel flow is obtained under more than one engine operating condition. In addition fuel is introduced directly into the crankcase at idle speeds instead of into the throttle bore giving more stable idle condition. Crankcase pressure is used to increase the pressure on the dry side of the metering diaphragm for starting the engine under extreme cold conditions or when the engine is in "vapor lock." In open throttle, no load condition the mixture is enriched so as to limit engine speed.

7 Claims, 1 Drawing Figure

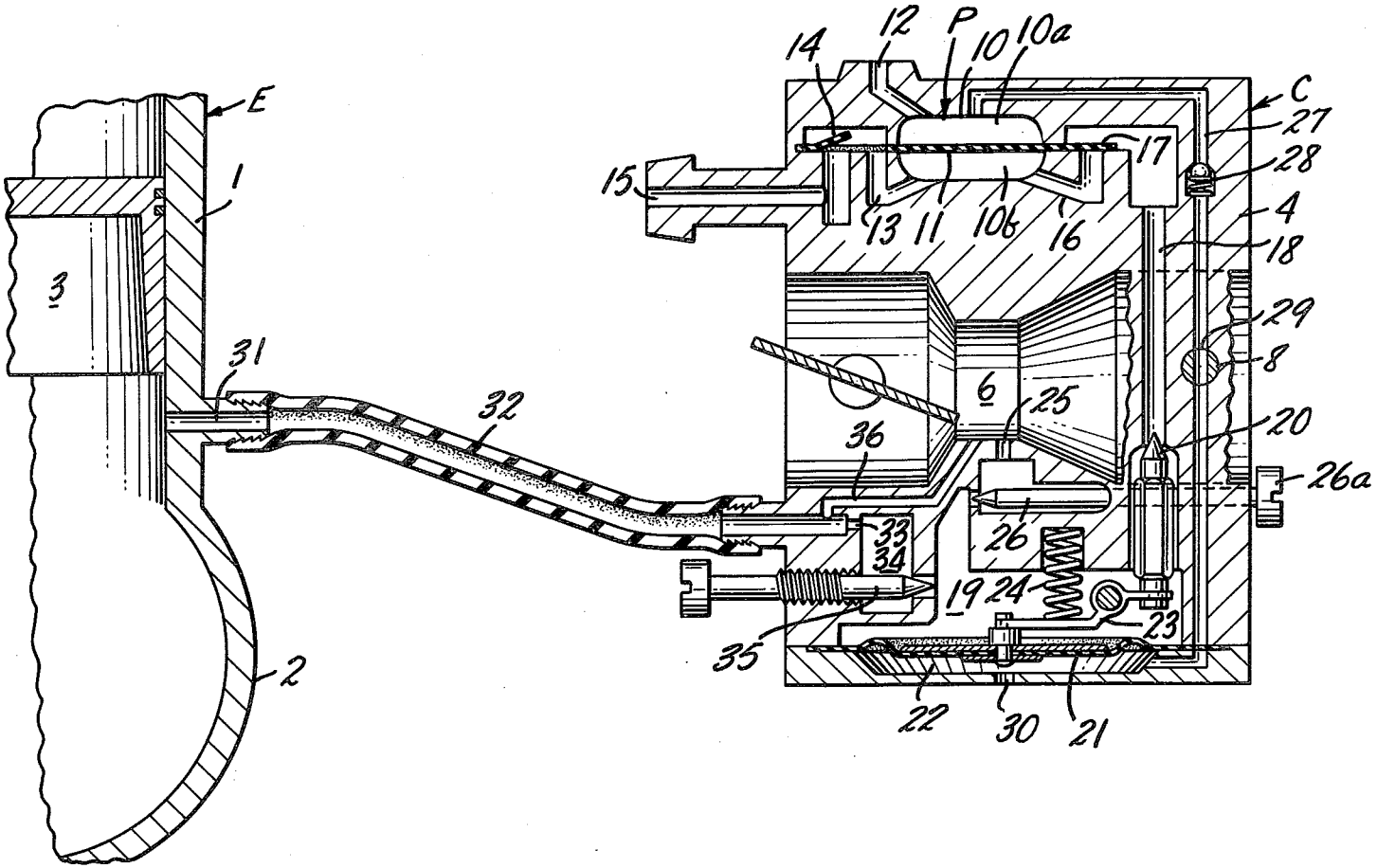
C
27
28
4
18
29
8
20
26a
17
16
10a
10
P
10b
11
12
13
14
15
6
25
26
24
23
21
30
22
19
33
34
36
35
32
31
E
1
2
3

DIAPHRAGM TYPE CARBURETOR FOR A TWO-STROKE CYCLE ENGINE

FIELD OF INVENTION

The present invention relates to a diaphragm type carburetor for a two-stroke cycle engine and is directed to the problem of providing the desired fuel flow under different engine operating conditions.

BACKGROUND OF THE INVENTION

The fuel flow in diaphragm type carburetors is dependent on the pressure differential existing between the carburetor venturi and the atmosphere. The venturi pressure depends upon engine design characteristics and operating conditions. Hence if the carburetor is set to deliver the proper quantity of fuel for one operating condition it may not deliver the desired quantity of fuel at all other operating conditions. Thus, for example, if the carburetor is set to provide the proper quantity of fuel for operating under full load open throttle conditions the fuel supply may not be proper when the engine is operating at idle speeds. Another problem is the limitation of engine speed under open throttle no load condition. While various governing devices have been provided these increase the cost weight and complexity of the engine and are frequently unreliable in operation. A further problem occurs in starting the engine under extreme temperature conditions or when the engine is in "vapor lock."

SUMMARY OF THE INVENTION

It is an object of the present invention to provide a diaphragm type carburetor for a two-stroke cycle engine which provides the proper quantity of fuel for starting and for different operating conditions. For example, the carburetor is made to increase fuel flow sufficiently at higher engine speeds so that the maximum operating engine speed is limited by reason of the mixture being too rich. In addition, at idle speeds fuel is introduced directly into the crankcase instead of into the throttle bore thereby giving a more stable idle condition. Another feature of the invention is the use of crankcase pressure to enrich the fuel mixture for starting the engine under extreme cold conditions or when the engine is in the state of "vapor lock." The choke valve commonly used for starting is a compromise that can deliver optimum air-fuel mixture only under normal starting conditions. By using crankcase pressure in accordance with the present invention, the choke system can be calibrated to improve starting under extreme conditions.

BRIEF DESCRIPTION OF DRAWING

The nature objects and advantages of the invention will be more fully understood from the following description of a preferred embodiment shown by way of example in the accompanying drawing in which the single view is a schematic cross section of a carburetor in accordance with the invention and a portion of the engine cylinder, crankcase and piston.

DESCRIPTION OF PREFERRED EMBODIMENT

In the drawing there is shown by way of example a diaphragm type carburetor C for a two-stroke cycle engine E having a cylinder (1) and crankcase (2) and reciprocating piston (3). The carburetor C comprises a body (4) having a throttle bore (5) and a venturi (6). A throttle valve (7) is provided in the throttle bore while a choke valve (not shown) is provided on a shaft (8) in a position to restrict the throttle bore when starting.

Fuel is supplied to the carburetor by a pump P comprising a pump chamber (10) divided by a flexible diaphragm (11) into a dry side (10*a*) and a wet side (10*b*). The dry side (10*a*) is connected by a passage (12) to the crankcase (2) of the engine so that the diaphragm (11) is actuated by crankcase pressure. The wet wide (10*b*) is connected through a passage (13) and check valve (14) to a fuel inlet (15) which is connected, for example by tubing, with the fuel tank. The fuel pump discharge (16) is connected through a check valve (17) and passage (18) with the metering chamber (19) of the carburetor. A needle valve (20) in the passage (18) is controlled by a diaphragm (21) between the metering chamber (19) and a dry chamber (22). The diaphragm (21) is connected with the valve member (20) by a lever (23) which is biased by a spring (24) in a direction to move the valve member toward closed position.

The main fuel jet (25) in the venturi (6) of the carburetor is connected to the metering chamber (24) through the adjustable high speed needle valve (26). The valve (26) is adjustable by means of a slotted head portion (26*a*).

The dry side (10*a*) of the pump chamber (10) is connected by a passage (27) with the chamber (22) on the dry side of the metering diaphragm (21). The passage (27) is controlled by a check valve (28) and by a valve (29) which is opened in starting conditions of the engine, i.e. when the choke valve is closed. By way of example, the valve (29) is shown as being a transverse bore in the choke valve shaft (8). However, it is possible to use other construction operating in a similar manner. The chamber (22) is vented to the atmosphere through a restricted orifice (30).

A port (31) in the cylinder wall of the engine E is connected through a passage (32) and a restricted orifice (33) with the idle reservoir (34) which in turn is connected with the metering chamber (19) through an orifice controlled by the idle mixture valve (35). The passage (32) is also connected through a vent passage (36) with the venturi of the carburetor.

OPERATION

The operation of the carburetor (will now be) in different operating conditions will now be described. When the engine is running at idle speed, crankcase vacuum draws fuel mixture from the metering chamber (19) through the idle reservoir (34) orifice (33) passage (32) and port (31) into the crankcase. Fuel flow is regulated by the idle mixture valve (35). By introducing the fuel directly into the crankcase instead of into the throttle bore, a more stable idle condition is achieved. This avoids the build-up of fuel droplets and puddles in the intake system between the carburetor and the crankcase which can cause unstable idling.

When the engine is operating with wide open throttle and under heavy load typically at a speed of 5,000 to 8,000 rpm, a selected portion of the crankcase pressure wave is allowed to enter the passage (32) when the piston uncovers the port (31) in the cylinder wall. The pressure pulse is diminished slightly by the vent passge (36) because the venturi (6) is at a relatively high pressure under these conditions. The pressure is transmitted to the metering chamber (19) in the form of air bubbles. Due to the pressure drop in the venturi (6) these bubbles are directed to the main nozzle (25) where they flow out, displacing fuel. High speed needle valve (26) is adjusted to obtain best engine power under these conditions.

When the engine is operating at wide open throttle and no load at a speed typically between 10,000 and 14,000 rpm., the pressure wave from the crankcase port is relatively lower and is diminished by that passage (36) by reason of the lower pressure prevailing in the venturi (6) under these conditions. The resultant low pressure causes less air bubbles to go out the main fuel jet (25), therefore the mixture is enriched. By selecting the proper locations and sizes of the various ports passages and orifices the fuel flow can be increased sufficiently at high speeds so that the maximum speed is limited. For example an engine that "no loads" at 14,000 rpm with a standard carburetor can be limited to 12,000 rpm with a carburetor in accordance with the present invention without any loss of power at lower speeds.

For starting, the shut-off valve (29) is opened by actuation of the choke so that pressure from the crankcase is transmitted through the passage (27) to the chamber (22) and pushes on the metering diaphragm (26) in a direction to attend to open the inlet needle valve (20). This enriches the fuel mixture for starting. Check valve (28) permits only the positive portion of the crankcase pressure wave to act on the metering diaphragm (21). Under vapor lock conditions, fuel tank pressure can push fuel through the carburetor, thereby purging pockets of vapor. The vent hole (30) is calibrated to maintain the chamber (22) on the dry side of the metering diaphragm (21) at atmospheric pressure during normal operation while restricting flow sufficiently to allow pressure build-up during starting.

It will thus be seen that the desired fuel flow is obtained during starting and during different conditions of engine operation. The port 31 is positioned to optimize the difference between the average pressure at normal speeds and the average pressure at high no-load speeds. The operation of the engine at different speeds is thereby substantially improved. While a preferred embodiment of the invention has been illustrated schematically in the drawing and is herein particularly described, it will be understood that many variations and modifications may be made and that the invention is in no way limited to the illustrated embodiment.

What is claimed is:

1. In combination with a two-stroke cycle internal combustion engine having a cylinder, a piston reciprocable in said cylinder and a crankcase, a diaphragm type carburetor comprising a body providing a venturi, a cavity in said body, a metering diaphragm dividing said cavity into a metering chamber and a dry chamber, means for supplying fuel to said metering chamber including metering valve means actuatable by said diaphragm, a main fuel jet connected with said metering chamber through a high speed needle valve, and means connecting said dry chamber with the crankcase of said engine during starting of said engine to apply crankcase pressure to said diaphragm to deflect said diaphragm in a direction to open said metering valve means to supply more fuel to said metering chamber and to said main fuel jet during starting of said engine.

2. A combination according to claim 1, in which said means connecting said dry chamber with said crankcase includes check valve means for transmitting only the positive portion of the pressure wave from the crankcase to said dry chamber.

3. A combination according to claim 2, in which said means connecting said dry chamber with said crankcase comprises shut-off valve means and means for opening said shut-off valve means only during engine starting.

4. A combination according to claim 1, further comprising an idle reservoir in said carburetor body, means including an idle mixture valve connecting said idle reservoir with said metering chamber, a port in a wall of said cylinder in position to be covered by said piston during a portion of said piston stroke and to be in communication with said crankcase during another portion of each piston stroke, and passage means connecting said port with said idle reservoir through said passage means to said crankcase when said engine is idling.

5. A combination according to claim 4, in which said passage means communicates with said idle reservoir through a restricted orifice.

6. A combination according to claim 5, further comprising a vent passage connecting said passage means with said venturi.

7. In combination with a two-stroke cycle internal combustion engine having a cylinder, a piston reciprocable in said cylinder and a crankcase, a diaphragm type carburetor comprising a body providing a venturi, a main fuel jet in said venturi, a metering chamber, means including a high speed valve connecting said metering chamber with said main fuel jet to supply fuel thereto, an idle reservoir in said carburetor body, means including an idle mixture valve connecting said idle reservoir with said metering chamber, a port in a wall of said cylinder in position to be covered by said piston during a portion of said piston stroke and to be in communication with said crankcase during another portion of each piston stroke, passage means connecting said port with said idle reservoir to supply fuel directly from said idle reservoir through said passage means to said crankcase when said engine is idling, said passage means communicating with said idle reservoir through a restricted orifice, and a vent passage connecting said passage means with said venturi.

* * * * *